US008316829B2

(12) United States Patent
Piper et al.

(10) Patent No.: US 8,316,829 B2
(45) Date of Patent: Nov. 27, 2012

(54) APPARATUS, SYSTEM, AND METHOD FOR EFFICIENTLY OPERATING AN INTERNAL COMBUSTION ENGINE UTILIZING EXHAUST GAS RECIRCULATION

(75) Inventors: Erik L. Piper, Columbus, IN (US); Philip M. Dimpelfeld, Columbus, IN (US); Santiago A. Durango, Dunlap, IL (US); Russell P. Durrett, Bloomfield, MI (US)

(73) Assignee: Cummins IP, Inc., Minneapolis, MN (US)

( * ) Notice: Subject to any disclaimer, the term of this patent is extended or adjusted under 35 U.S.C. 154(b) by 888 days.

(21) Appl. No.: 12/368,230

(22) Filed: Feb. 9, 2009

(65) Prior Publication Data

US 2009/0199825 A1 Aug. 13, 2009

Related U.S. Application Data

(60) Provisional application No. 61/027,346, filed on Feb. 8, 2008.

(51) Int. Cl.

| | |
|---|---|
| ***F02M 25/07*** | (2006.01) |
| ***F02B 47/08*** | (2006.01) |
| ***F02B 33/44*** | (2006.01) |
| ***F02D 41/06*** | (2006.01) |
| ***F02D 13/06*** | (2006.01) |

(52) U.S. Cl. ..... 123/568.21; 123/568.11; 123/198 F; 123/179.16; 60/605.2

(58) Field of Classification Search ..... 123/568.11–568.13, 568.21, 568.17, 123/568.18, 179.16, 179.18, 481, 491, 198 F; 60/602, 605.2; 701/103, 108

See application file for complete search history.

(56) References Cited

U.S. PATENT DOCUMENTS

| | | | | |
|---|---|---|---|---|
| 3,776,207 | A | 12/1973 | Simko | |
| 4,179,892 | A | 12/1979 | Heydrich | |
| 4,231,225 | A | 11/1980 | Aya | |
| 5,517,976 | A * | 5/1996 | Bachle et al. | 123/568.11 |
| 5,894,726 | A * | 4/1999 | Monnier | 123/568.11 |
| 5,937,834 | A * | 8/1999 | Oto | 123/568.18 |
| 6,324,847 | B1 | 12/2001 | Pierpont | |
| 6,386,154 | B1 | 5/2002 | Hellman et al. | |
| 6,752,132 | B2 * | 6/2004 | Remmels et al. | 123/568.11 |
| 6,789,531 | B1 * | 9/2004 | Remmels | 123/568.11 |
| 6,945,236 | B2 | 9/2005 | Nakai et al. | |

(Continued)

FOREIGN PATENT DOCUMENTS

JP 2006-177191 7/2006

(Continued)

OTHER PUBLICATIONS

PCT/US2009/033590, International Search Report and Written Opinion, Sep. 21, 2009.

(Continued)

*Primary Examiner* — Willis R Wolfe, Jr.
(74) *Attorney, Agent, or Firm* — Kunzler Law Group, PC

(57) ABSTRACT

An apparatus, system, and method are disclosed for efficiently operating an engine utilizing exhaust gas recirculation (EGR). The apparatus includes an exhaust manifold receiving exhaust gas from a first cylinder set, an EGR manifold receiving exhaust gas from a second cylinder set, and a passage comprising a variable restriction. The passage fluidly couples the exhaust manifold to the EGR manifold. The apparatus further includes a controller with modules for interpreting engine operating conditions and controlling actuators in response to the engine operating conditions.

22 Claims, 5 Drawing Sheets

U.S. PATENT DOCUMENTS

| | | | | |
|---|---|---|---|---|
| 6,988,365 | B2 | 1/2006 | Sasaki | |
| 7,437,874 | B2 * | 10/2008 | Ramamurthy et al. | 60/602 |
| 7,941,999 | B2 * | 5/2011 | Kasper et al. | 60/605.2 |
| 2002/0189598 | A1 | 12/2002 | Remmels et al. | |
| 2004/0074480 | A1 | 4/2004 | Chen et al. | |
| 2007/0310947 | | 6/2007 | Baumbard et al. | |
| 2007/0175457 | A1 * | 8/2007 | Lyons | 123/568.12 |

FOREIGN PATENT DOCUMENTS

| | | |
|---|---|---|
| JP | 2007-218171 | 8/2007 |

OTHER PUBLICATIONS

CN Application No. 200980104514.9 Office Action dated Apr. 6, 2012.

* cited by examiner

APPARATUS, SYSTEM, AND METHOD FOR EFFICIENTLY OPERATING AN INTERNAL COMBUSTION ENGINE UTILIZING EXHAUST GAS RECIRCULATION

CROSS-REFERENCE TO RELATED APPLICATION

This application claims priority to U.S. Provisional Patent Application No. 61/027,346, filed Feb. 8, 2008, which is incorporated herein by reference.

FIELD

This invention relates to apparatuses and methods for efficiently operating a combustion engine utilizing exhaust gas recirculation (EGR) and more particularly relates to managing pressure differentials across the engine.

BACKGROUND

Internal combustion engines provide an excellent source of work in a convenient package and are a critical part of the modern economy. Many of the recent advances in the internal combustion engine relate to reducing the emissions of the engine and specifically meeting emissions regulations promulgated by government agencies such as the Environmental Protection Agency. An important development in meeting emissions regulations is the introduction of exhaust gas recirculation (EGR). EGR reduces the peak combustion temperatures of the engine, and reduces the oxygen content in the cylinder, resulting in lower oxides of nitrogen ($NO_x$) emissions.

One requirement for the flow of EGR is that exhaust gas pressures must be higher than inlet gas pressures, or the exhaust gas will not flow to the intake as desired. Traditionally, this requires that the exhaust manifold pressure be maintained higher than the intake manifold pressure. This is undesirable, as it creates extra backpressure on the engine, and introduces work into the system that does not reach the crankshaft and reduces the efficiency of the engine. Also, the control of EGR flow rates often is achieved by the use of controlled backpressure using a turbocharger, often a variable geometry turbocharger (VGT). This causes the VGT to be chasing two parameters—both the desired work to compress inlet air and the desired exhaust manifold pressure to control the EGR flow rate. As a result, the control of the VGT is complex and sub-optimal to both EGR flow rates and intake air compression.

Combustion engines perform work through combusting hydrocarbons to create a pressure pulse generating a pressure differential across the engine, and further converting that pressure into mechanical work. Maintaining this pressure differential is essential to the efficient functioning of the engine, and therefore the introduction of backpressure into the engine is undesirable. However, many internal combustion engines use a portion of the generated pressure difference to operate an EGR system blending exhaust gas with inlet air to lower combustion temperatures, thereby reducing the formation of environmentally harmful $NO_x$. As lower emissions are targeted and the demand for fuel efficiency and power density of combustion engines continues many designers of internal combustion engines are challenged to improve the management of pressure within the engine.

SUMMARY

From the foregoing discussion, it should be apparent that a need exists for an apparatus, system, and method that efficiently operates an internal combustion engine utilizing EGR. Beneficially, such an apparatus, system, and method would provide substantial control of pressures within the engine including limiting the loss of pressure into the EGR system.

The present invention has been developed in response to the present state of the art, and in particular, in response to the problems and needs in the art that have not yet been fully solved by currently available apparatuses and methods. Accordingly, described herein are an apparatus, system, and method for efficiently operating a combustion engine utilizing EGR that overcome many or all of the above-discussed shortcomings in the art.

An apparatus is disclosed to efficiently operate an engine utilizing exhaust gas recirculation. The apparatus includes an exhaust manifold receiving exhaust from a first cylinder set, an exhaust gas recirculation (EGR) manifold receiving exhaust from a second cylinder set, and a passage comprising a variable restriction. The passage fluidly couples the exhaust manifold to the EGR manifold. In one embodiment, the second cylinder set may include up to one-half of the total number of cylinders. The variable restriction may comprise one of a two-way valve and a one-way valve. The apparatus may further include a variable geometry turbocharger (VGT), an EGR loop valve, an EGR flow module, an intake air module, a backpressure module, and an actuation module. Combustion may be suspended for the second set of cylinders during a cold start.

A system is disclosed to efficiently operate an engine utilizing EGR. The system includes a combustion engine having a first cylinder set and a second cylinder set, an exhaust manifold receiving exhaust gas from the first cylinder set, an EGR manifold receiving exhaust gas from the second cylinder set, a passage comprising a variable restriction, an intake manifold, and a turbocharger.

A method is disclosed to efficiently operate an engine utilizing EGR. The method includes providing an exhaust manifold receiving exhaust gas from a first cylinder set, providing an EGR manifold receiving exhaust gas from a second cylinder set, and providing a passage comprising a variable restriction. The method further includes detecting a set of current operating conditions for an engine, determining an EGR flow target, and engaging the variable restriction in response to the set of current operating conditions and the EGR flow target. The method may further include suspending combustion for the second cylinder set during a cold start. The passage may permit flow between the exhaust manifold and the EGR manifold above and below a nominal rate of flow inclusively. The method may further include providing flow actuators such as an EGR loop valve to control exhaust gas in the EGR loop, and a VGT to induce a variable backpressure on the exhaust manifold. The method may further provide an EGR flow module determining an EGR flow target, an intake air module determining a fresh air flow target, a backpressure module determining an exhaust manifold pressure target, and an actuation module controlling actuators to achieve the EGR flow target, the fresh air flow target, and the exhaust manifold pressure target.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

The features and advantages of various embodiments of the present invention will become more fully apparent from the following description and appended claims, or may be learned by the practice of the embodiments as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, a description and explanation of various embodiments of the invention with additional specificity and detail will be aided through the use of the accompanying drawings, in which.

DETAILED DESCRIPTION

Figure 1:
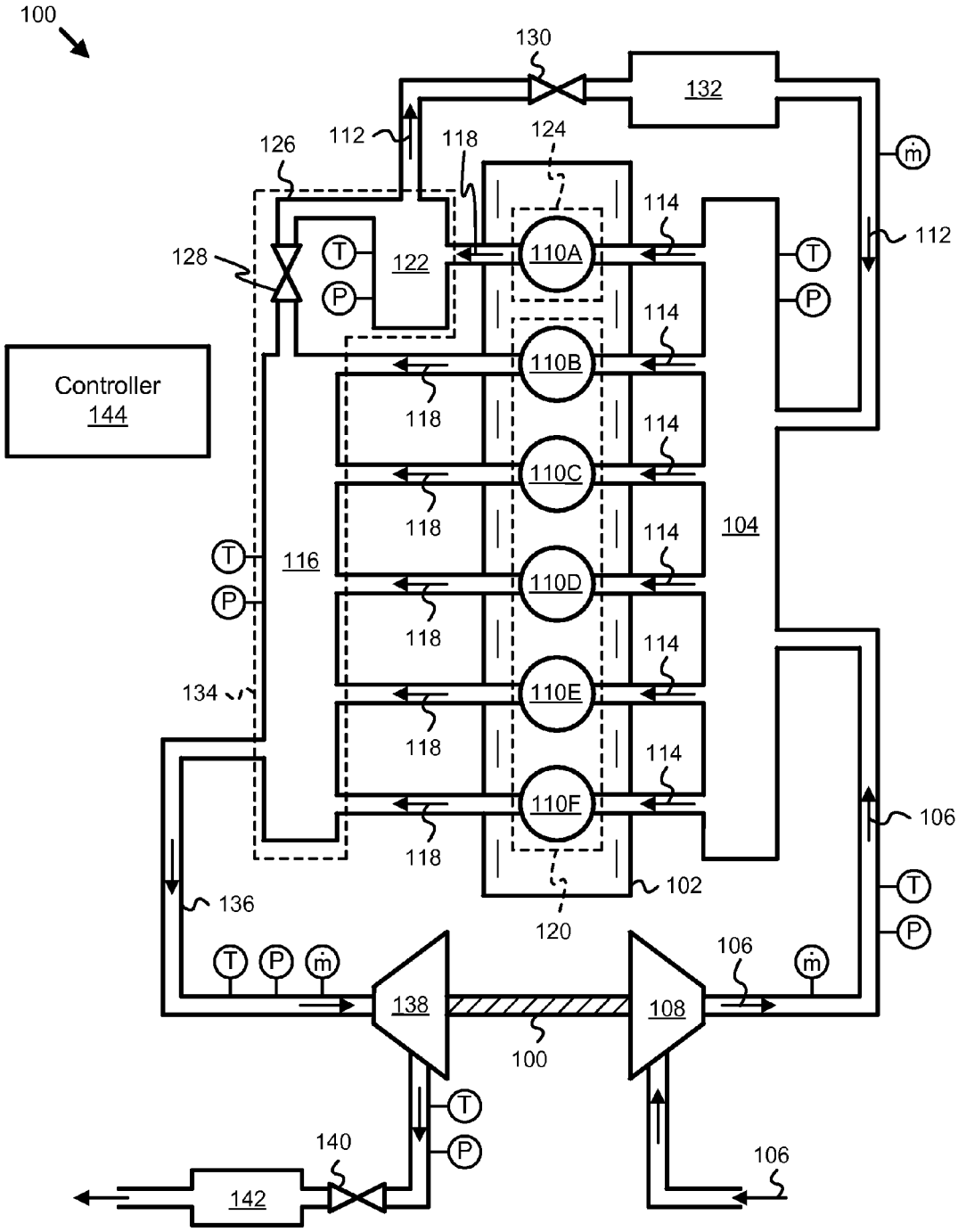
FIG. 1 is a schematic illustration depicting one embodiment of a system to efficiently operate a combustion engine utilizing EGR.

Many of the functional units described in this specification have been labeled as modules, in order to more particularly emphasize their implementation independence. For example, a module may be implemented as a hardware circuit comprising custom VLSI circuits or gate arrays, off-the-shelf semiconductors such as logic chips, transistors, or other discrete components. A module may also be implemented in programmable hardware devices such as field programmable gate arrays, programmable array logic, programmable logic devices or the like.

Modules may also be implemented in software for execution by various types of processors. An identified module of executable code may, for instance, comprise one or more physical or logical blocks of computer instructions which may, for instance, be organized as an object, procedure, or function. Nevertheless, the executables of an identified module need not be physically located together, but may comprise disparate instructions stored in different locations which, when joined logically together, comprise the module and achieve the stated purpose for the module.

Indeed, a module of executable code may be a single instruction, or many instructions, and may even be distributed over several different code segments, among different programs, and across several memory devices. Similarly, operational data may be identified and illustrated herein within modules, and may be embodied in any suitable form and organized within any suitable type of data structure. The operational data may be collected as a single data set, or may be distributed over different locations including over different storage devices, and may exist, at least partially, merely as electronic signals on a system or network.

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided, such as examples of programming, software modules, user selections, network transactions, database queries, database structures, hardware modules, hardware circuits, hardware chips, etc., to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

FIG. 1 is a schematic illustration depicting one embodiment of a system 100 to efficiently operate a combustion engine 102 utilizing EGR. The system 100 includes various sensors for monitoring operating conditions within a given embodiment. Sensors may be strategically disposed within the system 100 and may be in communication with a controller, such as controller 144. To illustrate the various locations and the types of sensors that may be useful for determining a set of operating conditions for the system 100, temperature sensors, pressure sensors, and mass flow sensors have been placed on the schematic illustration. One of skill in the art may determine the preferred placement and the preferred types of sensors for a particular application. On the schematic illustration of the system 100, temperature sensors are denoted with the letter 'T', pressure sensors are denoted with the letter 'P', and mass flow sensors are denoted with the 'm-dot' symbol. Furthermore, sensors may comprise virtual sensors detecting operating parameters of the system 100 based on other information, such as engine rpm for example.

The system 100 includes an intake manifold 104 receiving a fresh air stream 106 that may pass through a compressor 108. The compressor 108 may increase the pressure on the intake side of the engine 102 by compressing the fresh air stream 106, and further allowing more fuel to be combusted in a set of cylinders 110. The system 100 further includes an exhaust gas recirculation (EGR) flow 112 entering the intake manifold 104 and mixing with the fresh air stream 106 to form a blended stream 114.

The system 100 includes an exhaust manifold 116 receiving exhaust gas 118 from a first cylinder set 120. In the depicted embodiment of the system 100, the exhaust manifold 116 receives exhaust gas 118 from dedicated cylinders 110B, 110C, 110D, 110E, and 110F. An EGR manifold 122 receives exhaust gas 118 from a second cylinder set 124. In the depicted embodiment, the EGR manifold 122 receives exhaust gas 118 from dedicated cylinder 110A. In alternate embodiments of the system 100, the second cylinder set 124 may comprise between one and three cylinders 110 inclusively. For example, the second cylinder set 124 may include cylinder 110A and cylinder 110B, with the remaining cylinders 110C, 110D, 110E, and 110F included in the first cylinder set 120 (see, e.g., FIG. 2).

In one embodiment, the first cylinder set 120 and the second cylinder set 124 may each include any number of cylinders such that each set 120, 124 has at least one cylinder. For example, in a six cylinder engine 102, the first cylinder set 120 may be five cylinders while the second cylinder set 124 may be one cylinder. In another example, in a six cylinder engine 102, the first cylinder set 120 may be one cylinder, while the second cylinder set 124 may be five cylinders. In another example (not shown), in a six cylinder engine 102, the first cylinder set 120 may be two cylinders, while the second cylinder set 124 may be two cylinders, and two cylinders of the engine 102 may exhaust separately from both the exhaust manifold 116 and the EGR manifold 122.

The second cylinder set 124 may comprise any combination of cylinders 110, including non-sequential cylinders 110. For example, a second cylinder set 124 may include three cylinders 110 such as cylinders 110B, 110D, and 110F. An eight cylinder engine 102 may include a second cylinder set 124 comprising between one and four cylinders 110 inclusively. For any given combustion engine 102, the second cylinder set 124 may comprise up to one-half of a total number of cylinders 110. In a contemplated embodiment, combustion may be suspended for the second cylinder set 124 during a cold start of the engine.

The system 100 further includes a passage 126 including a variable restriction 128. The passage 126 fluidly couples the exhaust manifold 116 to the EGR manifold 122. In one embodiment, the variable restriction 128 includes a one-way valve 128 that permits flow from the exhaust manifold 116 to the EGR manifold 122. For example, with the one-way valve 128 fully closed, in an application using two of six cylinders 110 dedicated to EGR, the EGR may be set to a nominal EGR flow 112 of approximately 33% of the total exhaust gas 118 flow, the nominal EGR flow 112 being determined by the proportion of cylinders 110 dedicated to EGR. In the example, when an EGR flow 112 above the nominal EGR flow 112 is required, the one-way valve 128 is opened and a backpressure may be generated in the exhaust manifold 116 by a flow restriction downstream of the exhaust manifold 116, thus allowing an increase in EGR flow 112 above the nominal EGR flow 112 of 33%.

In an alternate embodiment of the system 100, the variable restriction 128 comprise a two-way valve 128 permitting exhaust flows between the exhaust manifold 116 and the EGR manifold 122 in either direction as required for a given application. For example, the two-way valve 128 may be partially opened to a designated setting corresponding to a desired nominal EGR flow 112. In the example, when an EGR flow 112 is required below the designated nominal EGR flow 112 the two-way valve 128 may be further opened. Correspondingly, when an EGR flow 112 is required above the designated nominal EGR flow 112 the two-way valve 128 may be further closed. The system 100 may further include an EGR loop valve 130 between the EGR manifold 122 and the intake manifold 104 permitting control of the exhaust gas in the EGR loop. In one embodiment, the system 100 further comprises an EGR cooler 132.

The system 100 includes an apparatus 134 to efficiently operate an engine utilizing EGR. In one embodiment the apparatus 134 includes the exhaust manifold 116, the EGR manifold 122, and the passage 126 including the variable restriction 128. The apparatus 134 may direct a portion of the exhaust gas 118 through the EGR loop and a remainder of the exhaust gas 118 through an exhaust passage 136. The exhaust passage 136 may direct the remaining exhaust gas through a turbocharger 138. In one embodiment the turbocharger 138 is a variable geometry turbocharger (VGT) 138 that induces a variable backpressure on the exhaust manifold 116. The VGT 138 may generate a backpressure in the exhaust stream that permits an increase in EGR flow 112 in specific applications. In embodiments using a standard turbocharger 138, a turbocharger outlet valve 140 may be place downstream of the turbocharger 138. The turbocharger outlet valve 140 may permit generation of backpressure on the exhaust manifold 116. The system 100 further includes an aftertreatment system 142 downstream of the turbocharger 138.

Referring again to FIG. 1, the system 100 includes a controller 144 configured to interpret sensor information for a set of engine operating conditions for the system 100. The controller 144 may communicate an actuator signal, in response to the set of engine operating conditions, to at least one actuator in the system 100. The manifold valve 128 may comprise one actuator in the system 100. Further actuator examples may include at least one actuator selected from the group of actuators consisting of the VGT 138, the EGR loop valve 130, and the turbocharger outlet valve 140. The controller 144 may comprise a plurality of modules including an operating conditions module, an EGR flow module, an intake air module, a backpressure module, and an actuation module.

Figure 2:
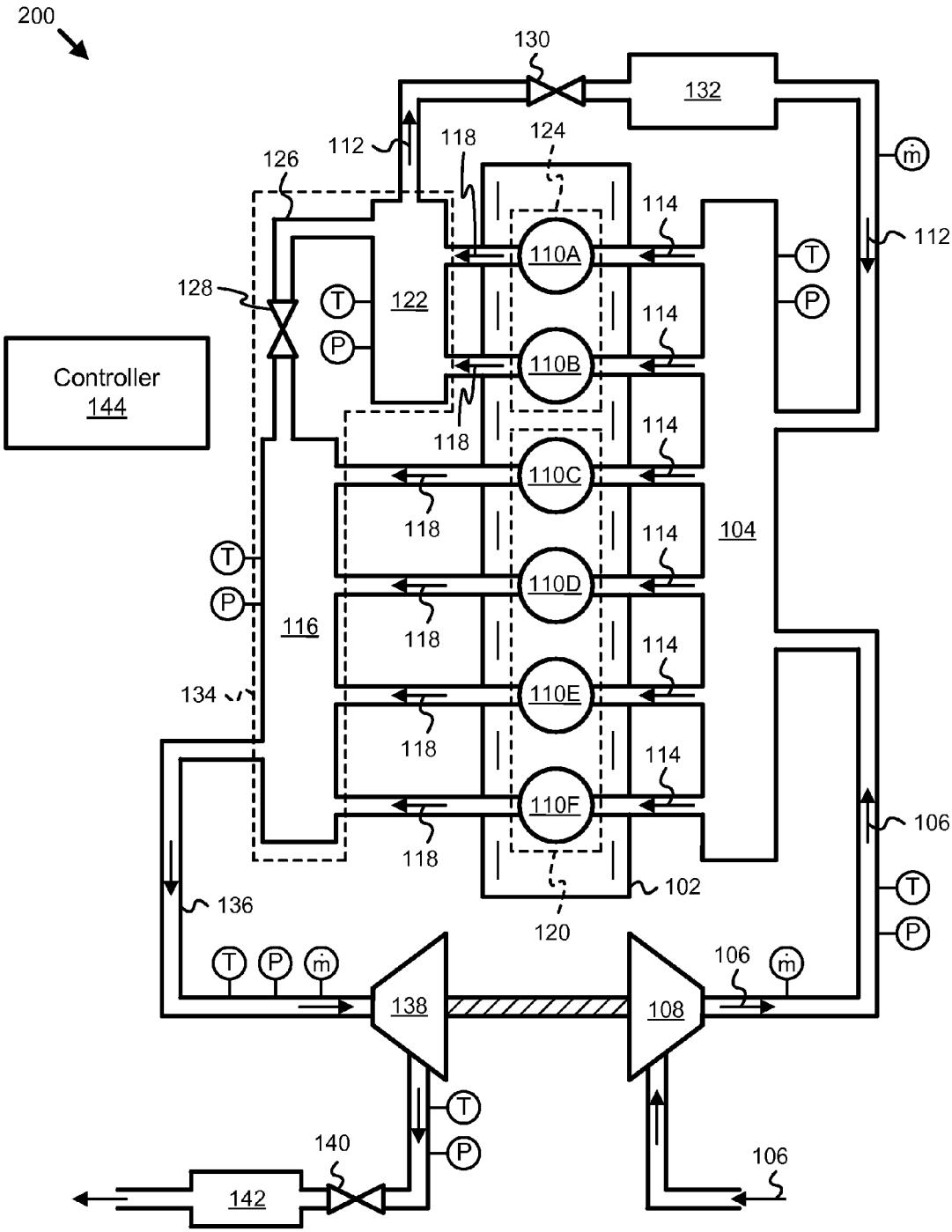
FIG. 2 is a schematic illustration depicting one embodiment of a system to efficiently operate a combustion engine utilizing EGR.

FIG. 2 is a schematic illustration depicting one embodiment of a system 200 to efficiently operate a combustion engine 102 utilizing EGR. The system 200 depicts an alternate embodiment of the system 100 with two cylinders 110A, 110B dedicated to EGR. The system 200 includes sensors, the intake manifold 104, the fresh air stream 106, the compressor 108, the EGR flow 112, the fresh air stream 106, and the blended stream 114.

The system 200 further includes the exhaust manifold 116 receiving exhaust gas 118 from the first cylinder set 120, which includes cylinders 110C, 110D, 110E, and 110F. Other embodiments of the system 200 may use alternate sequences of cylinders 110 for the first cylinder set 120. One of skill in the art may determine the optimal sequence of cylinders 110 for a particular application based on several criteria including, but not limited to, the design of the engine 102, packaging considerations, and performance aspects of the engine 102.

The system 200 further includes the EGR manifold 122, which receives exhaust gas 118 from the second cylinder set 124. In the depicted embodiment, the second cylinder set 124, which is dedicated to EGR, includes 110A and 110B. In alternate embodiments of the system 200, the second cylinder set 124 may comprise between one and three cylinders 110 inclusively. For example, the second cylinder set 124 may comprise cylinders 110A, 110C, and 110E. It is for one of skill in the art to determine the optimal number of cylinders 110, up to one half of the total number of cylinders 110 dedicated to EGR, and the sequence of those cylinders 110 most beneficial for a given application. Remaining cylinders 110 not dedicated to EGR may include the first cylinder set 120 and direct exhaust gas 118 into the exhaust manifold 116.

The system 200 further includes the passage 126, the variable restriction 128, the EGR loop valve 130, the EGR cooler 132, the apparatus 134, the exhaust passage 136, the turbocharger 138, the turbocharger outlet valve 140, the aftertreatment system 142, and the controller 144.

Figure 3:
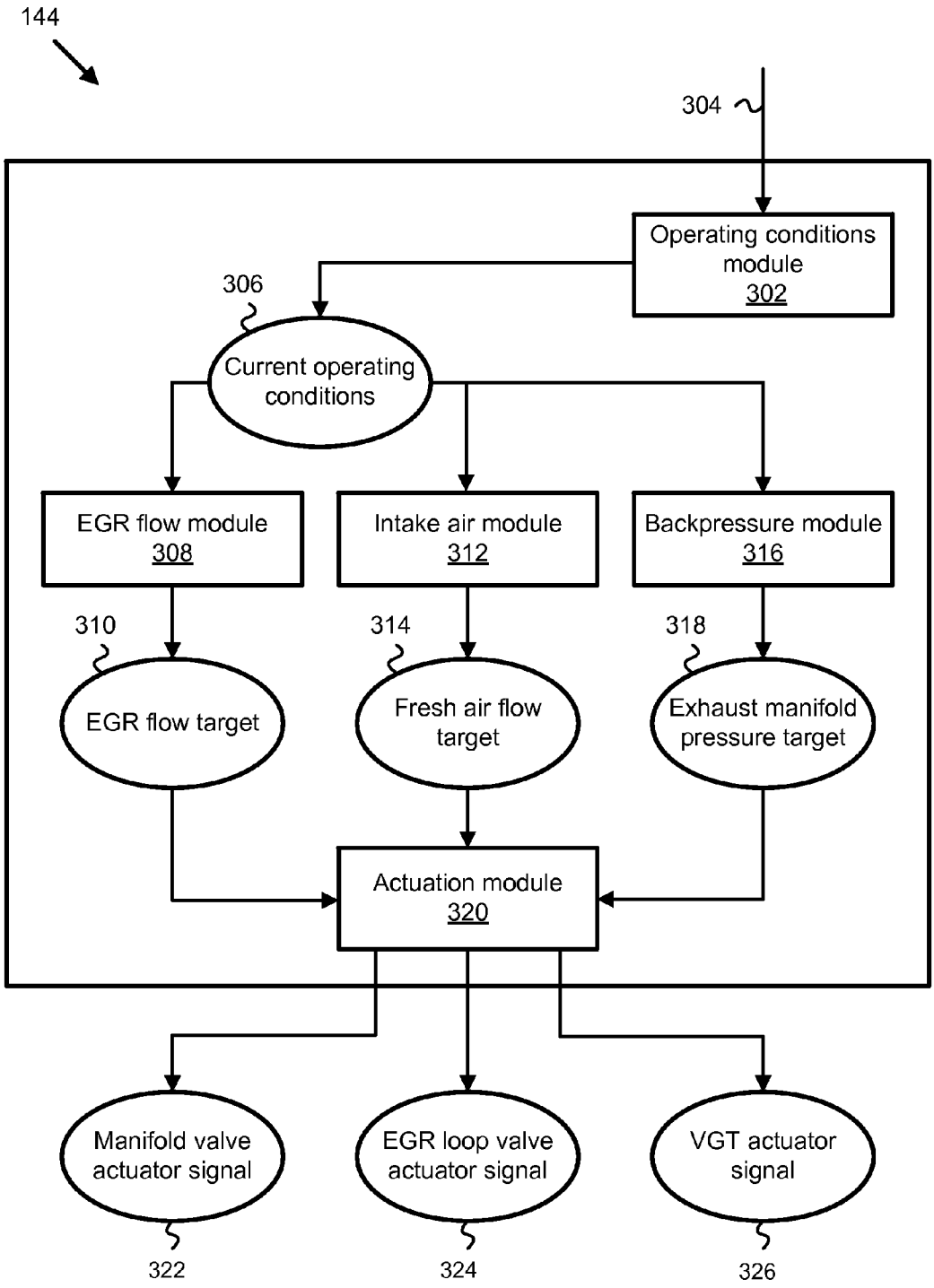
FIG. 3 is a schematic block diagram illustrating one embodiment of a controller to efficiently operate a combustion engine utilizing EGR.

FIG. 3 is a schematic block diagram illustrating one embodiment of the controller 144 to efficiently operate a combustion engine 102 utilizing EGR. The controller 144 includes an operating conditions module 302 configured to receive signals 304 from sensors and/or virtual sensors and determine a set of current operating conditions 306 for the engine 102 based at least in part on the signals received from the sensors. The set of current operating conditions 306 of interest for a given application may include, but are not limited to, engine speed, intake manifold temperature, intake manifold pressure, current fueling, current timing, exhaust manifold temperature, exhaust manifold pressure, turbine outlet temperature, turbine outlet pressure, intake fresh air flow, intake mixed air flow, exhaust flow upstream of the turbocharger, and/or exhaust flow upstream of the turbocharger. It is within the skill of one in the art to select the set of current operating conditions 306 to monitor, and determine the physical and/or virtual sensors useful for monitoring the selected set of current operating conditions 306 for a given application.

The controller 144 includes an EGR flow module 308 configured to determine an EGR flow target 310 based on a desired EGR flow for a set of current operating conditions 306. For example, for an engine 102 performing a cold start the EGR flow module 308 may produce a negligible EGR flow target 310.

The controller 144 further includes an intake air module 312 configured to produce a fresh air flow target 314 based on a desired fresh air flow target 314 for the set of current operating conditions 306. For example, increased fueling may be detected as one of the set of current operating conditions 306 and the intake air module 312 may be configured to increase the fresh air flow target 314 based on the increased fueling.

The controller 144 also includes a backpressure module 316 configured to determine an exhaust manifold pressure target 318 based on a desired exhaust manifold pressure for the set of current operating conditions 306. For example, an engine speed 306 may indicate that an engine 102 is at idle and the backpressure module 316 may be configured to decrease the exhaust manifold pressure target 318 based on the idle engine speed 306.

In one embodiment, the controller 144 further includes an actuation module 320 configured to control the manifold valve 128, the EGR loop valve 130, and the VGT 138 to achieve the EGR flow target 310, the fresh air flow target 314, and the exhaust manifold pressure target 318. The actuation module 320 is operable to produce a manifold valve actuator signal 322 to control the manifold valve 128, an EGR loop valve actuator signal 324 to control the EGR loop valve 130, and a VGT actuator signal 326 to control the VGT 138.

In other contemplated embodiments, the controller 144 may comprise other configurations of modules and actuators. One of skill in the art may determine the optimum configuration of modules and actuators to achieve the efficient operation of the engine 102 for a particular application. In one example, it may be determined that sufficient control of an engine 102 is achieved by a controller 144 comprising only the operating conditions module 302, the EGR flow module 308, the backpressure module 316, and the actuation module 320. In the preceding example, the actuators may comprise the manifold valve 128 and the VGT 138.

The schematic flow chart diagrams that follow are generally set forth as logical flow chart diagrams. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

Figure 4:
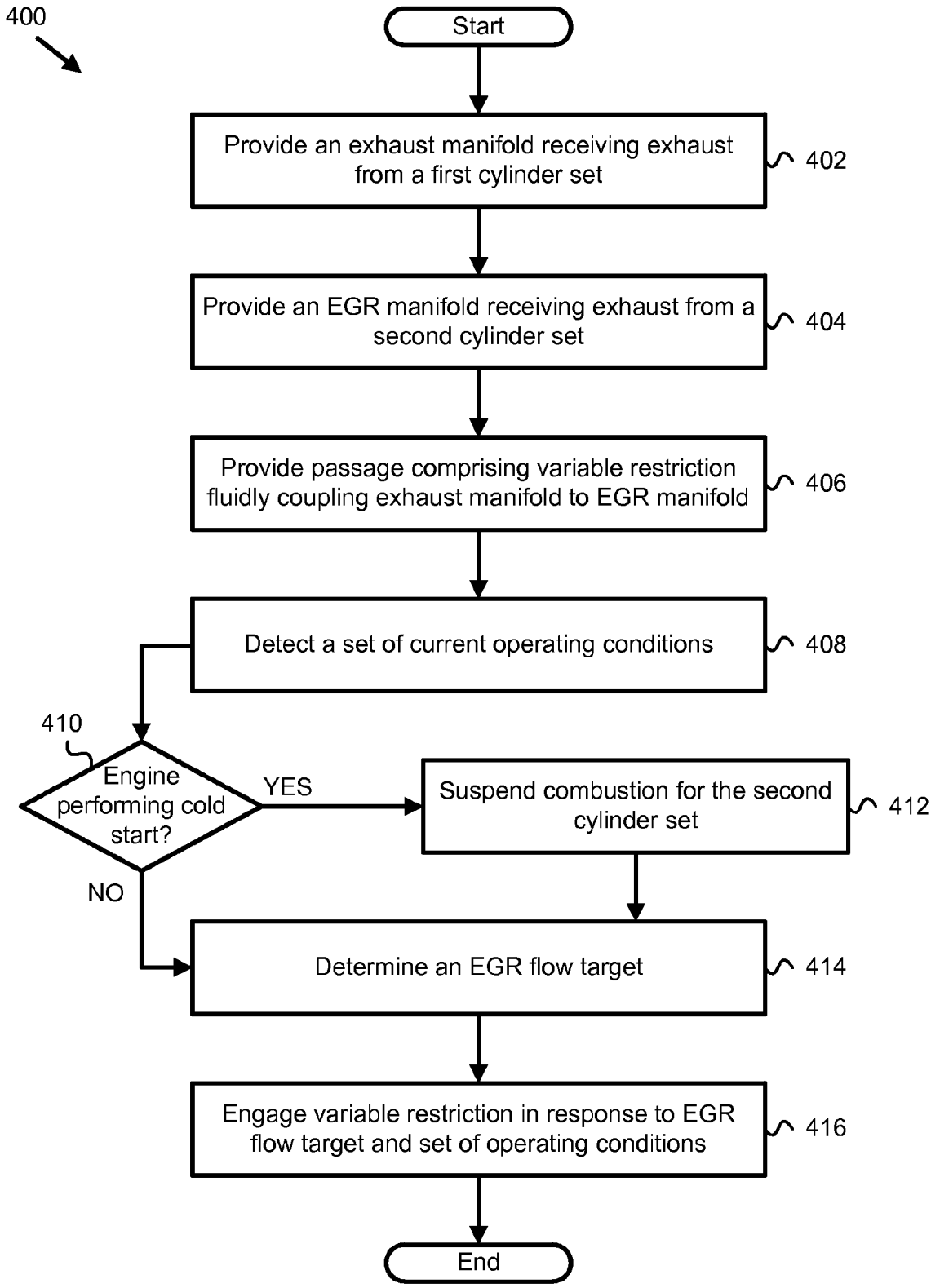
FIG. 4 is a schematic flow chart diagram illustrating one embodiment of a method to efficiently operate a combustion engine utilizing EGR.

FIG. 4 is a schematic flow chart diagram illustrating one embodiment of a method 400 to efficiently operate a combustion engine utilizing EGR. The method 400 comprises providing 402 an exhaust manifold 116 receiving exhaust gas 118 from a first cylinder set 120, and providing 404 an EGR manifold 122 receiving exhaust gas 118 from a second cylinder set 124. The method 400 further includes providing 406 a passage 126 comprising a variable restriction 128. The variable restriction 128 may comprise a manifold valve 128, the method 400 further comprising providing an EGR flow module 308 that controls the manifold valve 128 to achieve the EGR flow target 310. The passage 126 fluidly couples the exhaust manifold 116 to the EGR manifold 122. In one embodiment, the method 400 comprises providing the passage 126 permitting flow between the exhaust manifold 116 and the EGR manifold 122 above and below a nominal rate of flow inclusively.

The method 400 continues with detecting 408 a set of current operating conditions 306 for the engine 102. The method 400 also includes determining 410 whether an engine 102 is performing a cold start and suspending 412 the combustion for the second cylinder set 124 during a cold start. The method 400 further includes determining 414 an EGR flow target 310 and engaging 416 the variable restriction 128 in response to the EGR flow target 310 and the set of current operating conditions 306. In a contemplated embodiment, the method 400 further comprises providing flow actuators, the flow actuators comprising at least one flow actuator selected form the list of flow actuators consisting of the VGT 138, the EGR loop valve 130, and the turbocharger outlet valve 140. In one embodiment, the method 400 comprises operating the engine 102 with higher intake manifold pressure than exhaust manifold pressure, which may allow for a more efficient operation of the engine 102.

Figure 5:
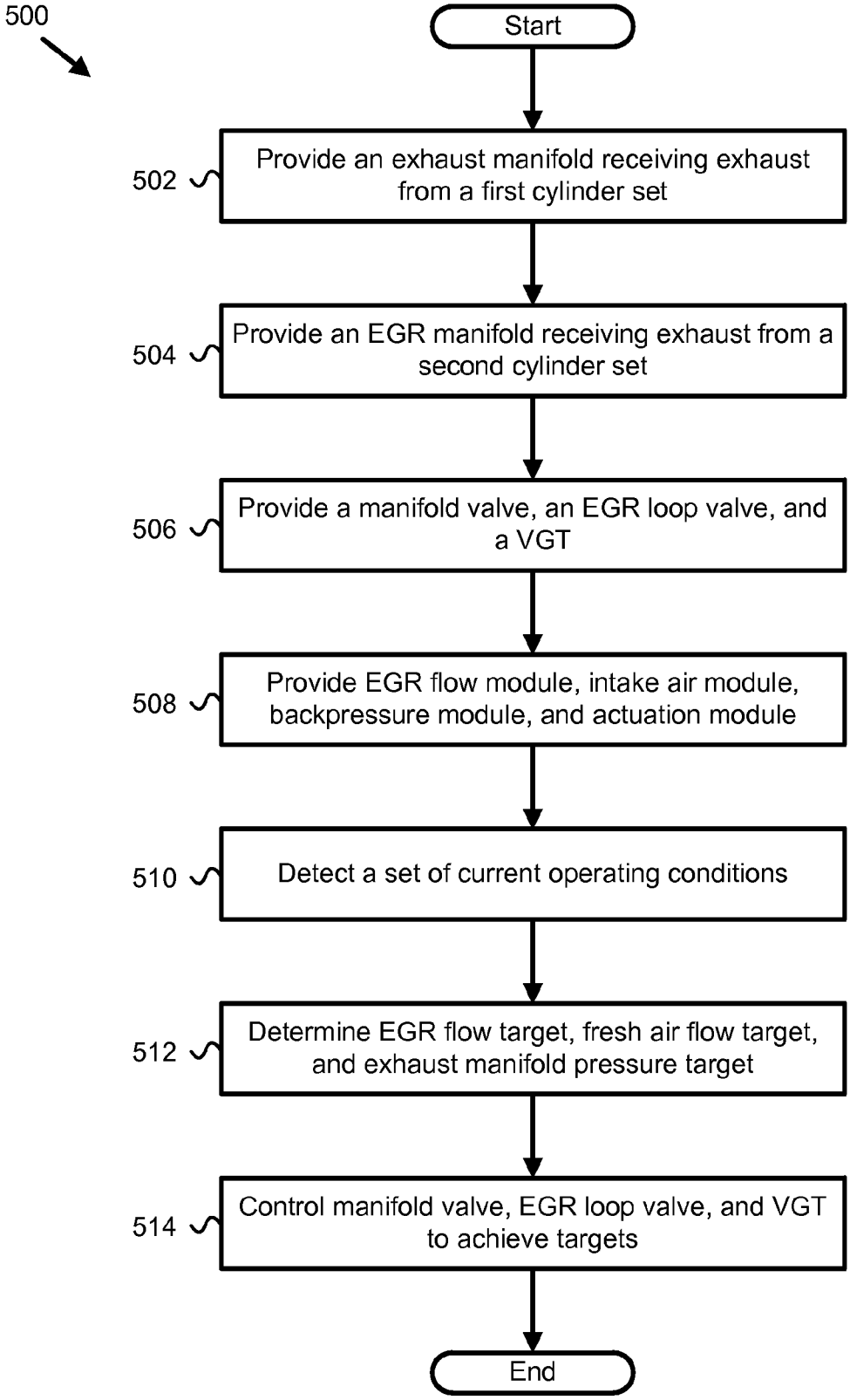
FIG. 5 is a schematic flow chart diagram illustrating one embodiment of a method to efficiently operate a combustion engine utilizing EGR.

FIG. 5 is a schematic flow chart diagram illustrating another embodiment of a method 500 to efficiently operate a combustion engine utilizing EGR. The method 500 includes providing 502 the exhaust manifold 116 receiving exhaust gas 118 from a first cylinder set 120 and providing 504 an EGR manifold 122 receiving exhaust gas 118 from a second cylinder set 124. The method 500 further includes providing 506 the manifold valve 128, the EGR loop valve 130, and the VGT 138. The method 500 continues by providing 508 the EGR flow module 308, the intake air module 312, the backpressure module 316, and the actuation module 320.

The method 500 also includes detecting 510 a set of current operating conditions 306 and determining 512 the EGR flow target 310, the fresh air flow target 314, and the exhaust manifold pressure target 318. The actuation module 320 may control 514 the manifold valve 128, the EGR loop valve 130, and the VGT 138, to achieve the EGR flow target 310, the fresh air flow target 314, and the exhaust manifold pressure target 318.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A system to efficiently operate an engine utilizing exhaust gas recirculation (EGR), the system comprising:

an exhaust manifold receiving exhaust gas from a first cylinder set of the engine;

an exhaust gas recirculation (EGR) manifold receiving exhaust gas from a second cylinder set of the engine; and a passage comprising a variable restriction, wherein the passage fluidly couples the exhaust manifold to the EGR manifold;

wherein combustion is suspended for the second cylinder set during a cold start of the engine.

2. The system of claim 1, wherein the variable restriction comprises a manifold valve, the system further comprising:

an intake manifold receiving intake air and an EGR stream from the EGR manifold;

a turbocharger receiving exhaust gas from the exhaust manifold, and inducing a backpres sure on the exhaust manifold, wherein the turbocharger comprises a variable geometry turbocharger (VGT) that induces a variable backpres sure on the exhaust manifold;

an EGR loop valve between the EGR manifold and the intake manifold; and a controller comprising:

an EGR flow module configured to determine an EGR flow target;

an intake air module configured to determine a fresh air flow target;

a backpressure module configured to determine an exhaust manifold pressure target; and an actuation module configured to control the manifold valve, the EGR loop valve and the VGT, in response to the EGR flow target, the fresh air flow target and the exhaust manifold pressure target.

3. The system of claim 1, wherein the variable restriction comprises a manifold valve, the system further comprising:

an intake manifold receiving intake air and an EGR stream from the EGR manifold;

a turbocharger receiving exhaust gas from the exhaust manifold, and inducing a backpres sure on the exhaust manifold, wherein the turbocharger comprises a variable geometry turbocharger (VGT) that induces a variable backpres sure on the exhaust manifold;

an EGR loop valve between the EGR manifold and the intake manifold;

a turbocharger outlet valve that induces a variable backpres sure on the exhaust manifold; and a controller comprising:

an EGR flow module configured to determine an EGR flow target;

an intake air module configured to determine a fresh air flow target;

a backpressure module configured to determine an exhaust manifold pressure target; and an actuation module configured to control the manifold valve, the EGR loop valve and the turbocharger outlet valve, in response to the EGR flow target, the fresh air flow target and the exhaust manifold pressure target.

4. An apparatus to efficiently operate an engine utilizing exhaust gas recirculation, the apparatus comprising:

an exhaust manifold receiving exhaust gas from a first cylinder set;

an exhaust gas recirculation (EGR) manifold receiving exhaust gas from a second cylinder set; and a passage comprising a variable restriction, wherein the passage fluidly couples the exhaust manifold to the EGR manifold;

wherein the variable restriction comprises one of a two-way valve and a one-way valve, the one way valve permitting flow from the exhaust manifold to the EGR manifold;

wherein combustion is suspended for the second cylinder set during a cold start.

5. The apparatus of claim 4, wherein the second cylinder set comprises between one and three cylinders.

6. The apparatus of claim 4, wherein the second cylinder set comprises between one and four cylinders.

7. The apparatus of claim 4, wherein the second cylinder set comprises up to one-half of a total number of cylinders.

8. The apparatus of claim 4, wherein the first cylinder set comprises at least one cylinder, and wherein the second cylinder set comprises at least one cylinder.

9. The apparatus of claim 4, further comprising an EGR loop valve between the EGR manifold and an intake manifold.

10. The apparatus of claim 4, further comprising a variable geometry turbocharger (VGT) that induces a variable backpres sure on the exhaust manifold.

11. The apparatus of claim 4, wherein the variable restriction comprises a manifold valve, the apparatus further comprising an EGR flow module configured to determine an EGR flow target, and an actuation module configured to control the manifold valve in response to the EGR flow target.

12. The apparatus of claim 4, wherein the variable restriction comprises a manifold valve, the apparatus further comprising:

a variable geometry turbocharger (VGT) that induces a variable backpres sure on the exhaust manifold;

an EGR flow module configured to determine an EGR flow target;

a backpressure module configured to determine an exhaust manifold pressure target; and an actuation module configured to control the manifold valve and the VGT in response to the EGR flow target and the exhaust manifold pressure target.

13. The apparatus of claim 4, wherein the variable restriction comprises a manifold valve, the apparatus further comprising:

an EGR loop valve between the EGR manifold and an intake manifold;

a variable geometry turbocharger (VGT) that induces a variable backpres sure on the exhaust manifold;

an EGR flow module configured to determine an EGR flow target;

an intake air module configured to determine a fresh air flow target;

a backpressure module configured to determine an exhaust manifold pressure target; and an actuation module configured to control the manifold valve, the EGR loop valve and the VGT, in response to the EGR flow target, the fresh air flow target and the exhaust manifold pressure target.

14. A method to efficiently operate an engine utilizing exhaust gas recirculation (EGR), the method comprising:

providing an exhaust manifold receiving exhaust gas from a first cylinder set;

providing an exhaust gas recirculation (EGR) manifold receiving exhaust gas from a second cylinder set;

providing a passage comprising a manifold valve, wherein the passage fluidly couples the exhaust manifold to the EGR manifold;

providing a flow restriction downstream of the exhaust manifold, the flow restriction capable of generating a variable backpres sure in the exhaust manifold;

determining an EGR flow target;

determining an exhaust manifold pressure target; and controlling the manifold valve and flow restriction to achieve the EGR flow target and the exhaust manifold pressure target.

15. The method of claim 14, further comprising suspending combustion for the second cylinder set during a cold start.

16. The method of claim 14, further comprising providing the passage permitting flow between the exhaust manifold and the EGR manifold above and below a nominal rate of flow inclusively.

17. The method of claim 16, further comprising a nominal EGR flow target, wherein the EGR flow target comprises a value between zero EGR flow and an EGR flow value higher than the nominal EGR flow target, inclusive.

18. The method of claim 14, further comprising a nominal EGR flow target, wherein the EGR flow target comprises a value no less than the nominal EGR flow target.

19. The method of claim 14, further comprising providing at least one flow actuator, each flow actuator comprising a member selected from the list consisting of a variable geometry turbocharger (VGT), an EGR loop valve, and a turbocharger outlet valve.

20. The method of claim 14, wherein the variable restriction comprises a manifold valve, the method further comprising controlling the manifold valve to achieve the EGR flow target.

21. The method of claim 14, the method further comprising:

providing an EGR loop valve between the EGR manifold and an intake manifold;

determining a fresh air flow target; and controlling the manifold valve, the EGR loop valve and the flow restriction, to achieve the EGR flow target, the fresh air flow target and the exhaust manifold pressure target.

22. The method of claim 14, further comprising operating an internal combustion engine with a higher intake manifold pressure than exhaust manifold pressure.

* * * * *